US009004620B2

(12) United States Patent
Baruch et al.

(10) Patent No.: US 9,004,620 B2
(45) Date of Patent: Apr. 14, 2015

(54) STORAGE ASSEMBLY

(71) Applicant: The Stanley Works Israel Ltd., Rosh Ha'Ayin (IL)

(72) Inventors: Danny Baruch, Lapid (IL); Elad Hay Shitrit, Tel Aviv (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 14/019,976

(22) Filed: Sep. 6, 2013

(65) Prior Publication Data

US 2014/0070677 A1 Mar. 13, 2014

(30) Foreign Application Priority Data

Sep. 11, 2012 (EP) ..... 12183855

(51) Int. Cl.
*E05B 65/46* (2006.01)
*B25H 3/02* (2006.01)

(52) U.S. Cl.
CPC ..... *E05B 65/467* (2013.01); *B25H 3/028* (2013.01); *E05B 65/462* (2013.01)

(58) Field of Classification Search
CPC ..... E05B 65/46; E05B 65/462; E05B 65/463; E05B 65/0003; E05B 65/467
USPC ..... 312/257.1, 216, 217, 218, 219, 220, 312/221, 107.5, 902; 70/78, 85
See application file for complete search history.

(56) References Cited

U.S. PATENT DOCUMENTS

| | | | | |
|---|---|---|---|---|
| 5,385,039 | A * | 1/1995 | Feldpausch et al. | 70/78 |
| 6,412,317 | B1 * | 7/2002 | Martin | 70/81 |
| 6,743,854 | B2 * | 6/2004 | Yeats et al. | 524/731 |
| 2002/0070640 | A1 * | 6/2002 | Hamilton et al. | 312/107.5 |
| 2006/0132005 | A1 * | 6/2006 | Cheng | 312/219 |

* cited by examiner

*Primary Examiner* — James O Hansen
(74) *Attorney, Agent, or Firm* — Adan Ayala

(57) ABSTRACT

A storage assembly has a container, a plurality of drawers arranged to be located in the container, and a gang lock arrangement. The gang lock includes a locking member located in the container and a locking unit locatable in the container. The locking unit has a support, and also a shifting part and a retaining part carried by the support. The shifting part is arranged to move the locking member with respect to the container such that the locking member releasably engages with, and thus releasably retains, the plurality of drawers in the container. The retaining part includes a resiliently biased latch member arranged to releasably retain the locking unit in the container.

18 Claims, 5 Drawing Sheets

STORAGE ASSEMBLY

FIELD

The present invention relates to storage assemblies and particularly to storage assemblies for storing medical supplies, tools, accessories for tools, etc.

BACKGROUND

Gang lock arrangements for filing cabinets and the like, in which a plurality of drawers may be locked in a closed position by means of a single locking arrangement, have been used for many decades. For example, U.S. Pat. No. 2,829,021 discloses such an arrangement in which one of the drawers—a lock drawer—of a multi-drawer cabinet includes a plunger for moving a pair of locking rods such that all of the drawers are retained in their closed position. The lock drawer also includes a locking bolt and combination lock, to lock the plunger in place, thereby locking all of the drawers, including the lock drawer, in their closed position.

Additionally, U.S. Pat. No. 3,070,046 discloses a multi-drawer cabinet in which a locking unit includes a pair of lift bolts arranged to lift corresponding lock bars of a gang lock arrangement, to retain all of the drawers in their closed position. The locking unit includes a locking means with a combination lock, to lock the lift bolts in place, thereby locking the drawers in their closed position. The locking unit is described as a lock drawer, but it is held in place in the cabinet by means of metal screws.

SUMMARY

Disclosed herein is an improved storage assembly which preferably enables easier assembly and disassembly, for example for cleaning of the storage assembly and/or for modifying or replacing the drawers and/or locking unit of the assembly. Such storage assembly has particular utility for medical storage assemblies, and is described herein primarily in those terms, but also has utility for other purposes, e.g. for storing tools and/or accessories for tools.

The disclosed storage assembly may comprise a container, a plurality of drawers arranged to be located in the container, and a gang lock arrangement, which in turn preferably has a locking member located in the container and a locking unit locatable in the container. The locking unit may include a support, and a shifting part and a retaining part carried by the support. The shifting part is preferably arranged to move the locking member with respect to the container such that the locking member releasably engages with, and thus releasably retains, the plurality of drawers in the container. The retaining part may comprise a resiliently biased latch member arranged to releasably retain the locking unit in the container.

The locking unit may include a retaining part comprising a resiliently biased latch member arranged to releasably retain the locking unit in the container. Consequently, quick and easy removal of the locking unit from the container can be enabled, for example, to aid cleaning of the interior of the container and the locking unit, or for replacement of the locking unit. This can be especially advantageous for medical storage requirements, for example.

The latch member of the retaining part of the locking unit preferably is resiliently biased with respect to the support. Preferably, at least one resilient member is arranged to resiliently bias the latch member, preferably away from at least part of the support. The resilient member(s) preferably is/are located between the latch member and at least part of the support, for example as part of a latch assembly comprising the resilient member(s) and the latch member. The, or each, resilient member may comprise a spring and/or a resiliently flexible arm, for example.

The latch member may be arranged to releasably engage with a part of the container located in the interior thereof. Preferably, the latch member is arranged to releasably engage with a protruding part of the container. Advantageously, the latch member may include one or more tabs (e.g. parts to be manipulated by finger), for a user to move to release the latch member, and thus also to release the locking unit, from the container.

The container preferably comprises a base, a top wall, two opposite side walls and a back wall, defining an interior space with an open, or openable, front for receiving the drawers and the locking unit in the interior space. The interior space of the container may also be arranged to contain one or more dividers, preferably shelf-like dividers, to divide rows and/or columns of the drawers. The dividers preferably are removable from the container. Preferably the drawers are arranged to slide and/or role on the dividers and/or the side walls of the container. The walls and/or dividers and/or drawers of the storage assembly preferably are formed from polymeric materials, but other materials could be used.

The storage assembly may, for example, comprise a storage box, a storage cabinet, or a storage or supply trolley or cart. When in the form of a storage cabinet, the storage assembly may, or may not, include one or more doors in front of the drawers. When in the form of a trolley or cart, the storage assembly preferably includes wheels or rollers.

The support of the locking unit preferably includes one or more engagement members spaced apart from the latch member, and the interior of the container preferably includes one or more corresponding receiving members arranged to receive the engagement member(s), to assist in the retention of the locking unit in the container. The engagement member(s) preferably is/are located on an upper region of the support of the locking unit, and the receiving member(s) preferably is/are situated on the underside of the top wall of the container.

Preferably, the support of the locking unit comprises a housing of the locking unit. The shifting part of the locking unit preferably extends through, and out of, the housing, e.g. substantially from a front region of the locking unit to a back of the locking unit, such that it extends out of the back of the housing. The latch member preferably is at least partly located on the exterior of the housing, e.g. on a region of the housing towards the front of the locking unit. The housing of the locking unit preferably is formed from metal, but other materials, such as polymeric materials, may be used.

The locking member preferably is located on the back wall inside the container, and preferably has the form of a frame. The locking member preferably is removable from the container.

Advantageously, the locking unit may have substantially the same length and/or depth and/or width as the drawers. A front surface of the support of the locking unit preferably is arranged to be substantially level with corresponding front surfaces of the drawers, when the locking unit is located in the container and the drawers are retained in the container by the locking member. The locking unit preferably further comprises a lock to lock the shifting part in a position in which the locking member is in engagement with, and thus retains, the plurality of drawers in the container. The lock may be arranged to be locked and unlocked by means of a key and/or a transponder and/or a keypad, for example.

BRIEF DESCRIPTION OF THE DRAWINGS

Corresponding features of different embodiments of the invention are described using the same reference numerals, for simplicity.

DETAILED DESCRIPTION

Figure 1:
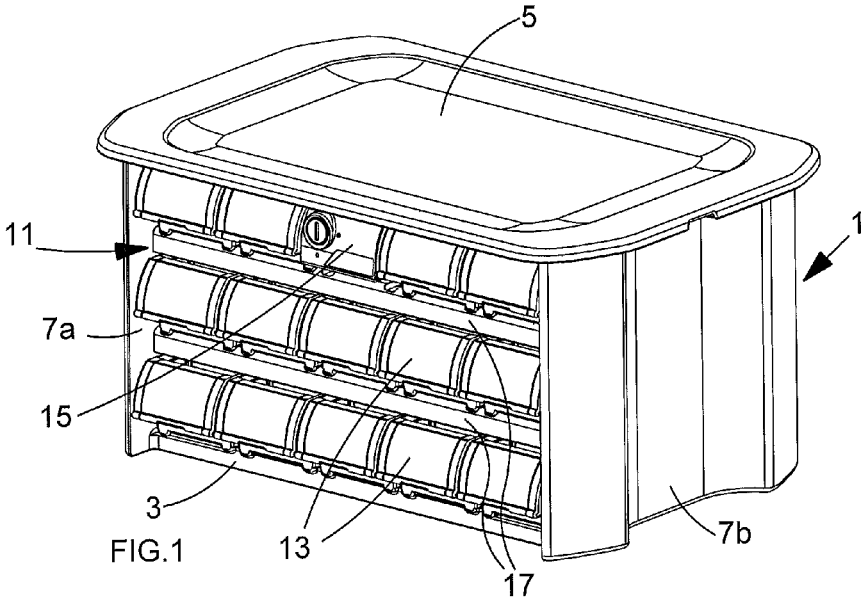
FIG. 1 shows an embodiment of a storage assembly, in the form of a storage box.

FIG. 1 shows an embodiment of a storage assembly in the form of a storage box. The storage assembly preferably comprises a container 1. The container 1 may comprise a base 3, a top wall 5, two opposite side walls 7*a* and 7*b* and a back wall 9 (not visible in FIG. 1 but shown in FIGS. 3 and 4), defining an interior space with an open front 11 for receiving a plurality of drawers 13 and a locking unit 15 in the interior space. The interior space of the container 1 may also contain a plurality of removable shelf-like dividers 17 on which the drawers 13 are arranged to slide in and out of the interior space of the container.

Figure 2:
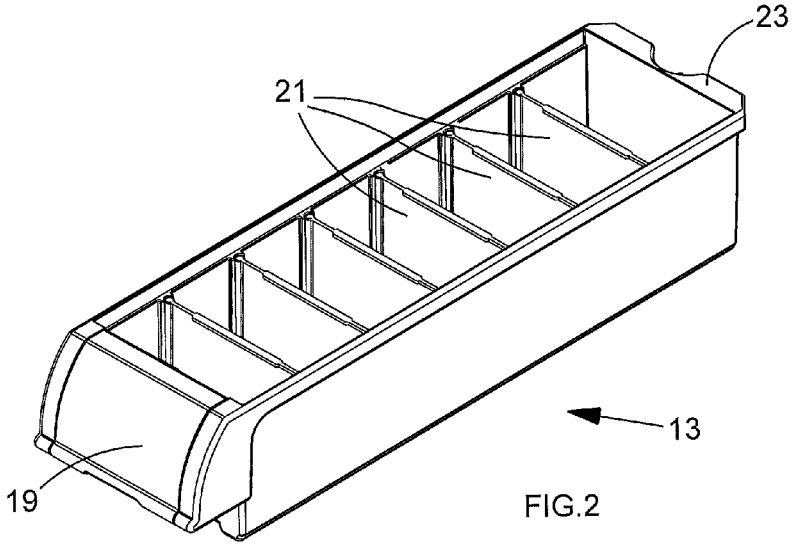
FIG. 2 shows a drawer similar to the drawers of the storage box of FIG. 1.

FIG. 2 shows a drawer 13 similar to the drawers of the storage assembly shown in FIG. 1. The drawer 13 may have a front part 19 which may be grasped to slide the drawer out of, and into, the container 1. The drawer 13 is preferably narrow and elongate in shape, but other shapes of drawer (e.g. wider and/or taller in relation to depth) may be used. The drawer 13 may be divided into a plurality of compartments by means of removable dividing panels 21. A rear retention part 23 of the drawer 13 is preferably arranged to be releasably engaged by a locking member 25 of the storage assembly (see FIGS. 3 and 4) to releasably retain the drawer in a fully inserted position in the container 1.

Figure 3A:
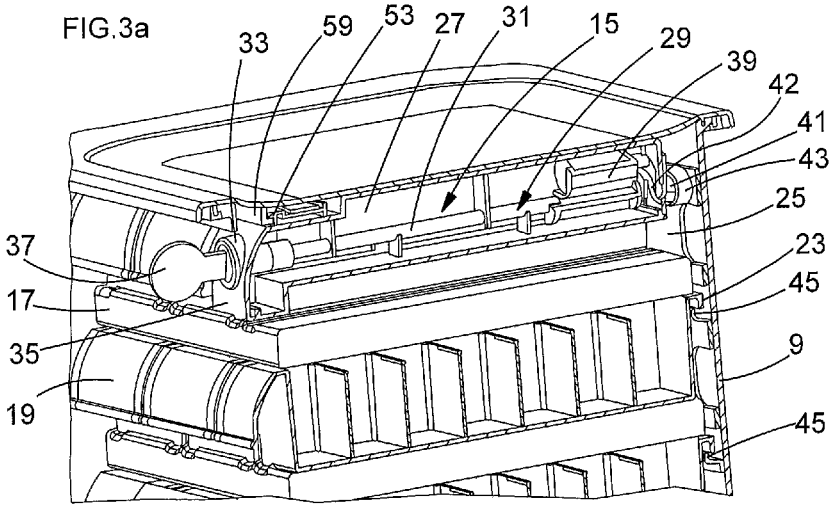
FIGS. 3*a* and 3*b* show cross-sectional views of a storage assembly similar to that shown in FIG. 1.
Figure 3B:
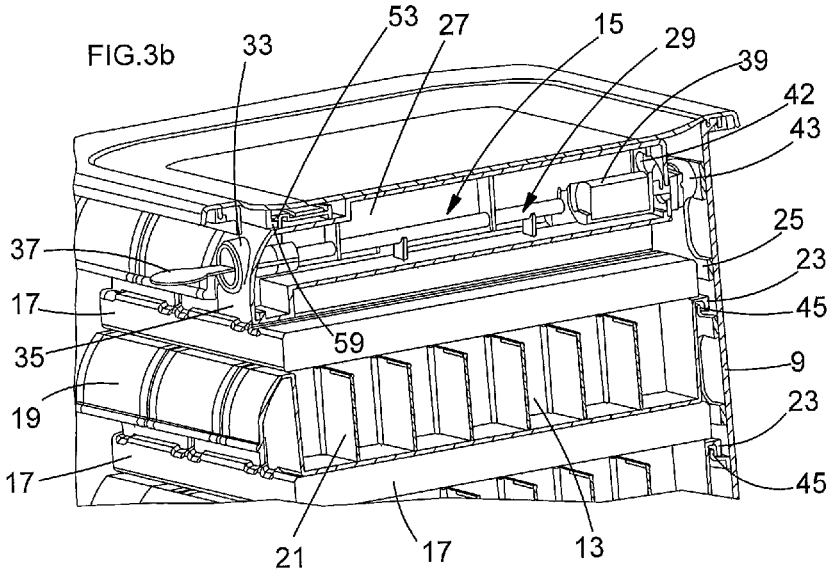

The cross-sectional views of FIGS. 3*a* and 3*b* show the gang lock arrangement of the storage assembly, preferably comprising the locking member 25 in the form of a frame, and the locking unit 15. The locking unit 15 may comprise a support 27 in the form of a housing through which extends a shifting part 29 which is arranged to move the locking member 25. The shifting part 29 may comprise a lock rod 31 which extends from a lock 33 located at the front 35 of the locking unit 15. The lock rod is preferably rotatable by means of a suitable key 37 being rotated in the lock.

A lifting arrangement 39 may be eccentrically mounted on the lock rod 31 at the rear of the locking unit 15 in the support housing 27. A pin 41 (see FIG. 5*b*), which projects from the rear of the locking unit outside the support housing 27, may be eccentrically mounted on the lifting arrangement 39. Part of the eccentrically mounted lifting arrangement 39 may extend through a curved slot 42 in the rear wall of the support housing 27 of the locking unit 15. The arrangement is such that when the lock rod 31 is rotated by the key 37, the eccentrically mounted pin 41 is preferably raised or lowered substantially in a vertical line, because the lateral movement of the pin which would otherwise have occurred is substantially cancelled out by the additional eccentric mounting of the lifting arrangement 39 on the lock rod 31. The pin 41 preferably extends into a recess 43 of the locking member 25, and thus raises and lowers the locking member as the key 37 is rotated in the lock 33.

The locking member 25 preferably includes projections 45 arranged to be received in corresponding recesses of the retention parts 23 of the drawers 13, to releasably engage, and thus releasably retain, the drawers in the container 1.

Figure 4:
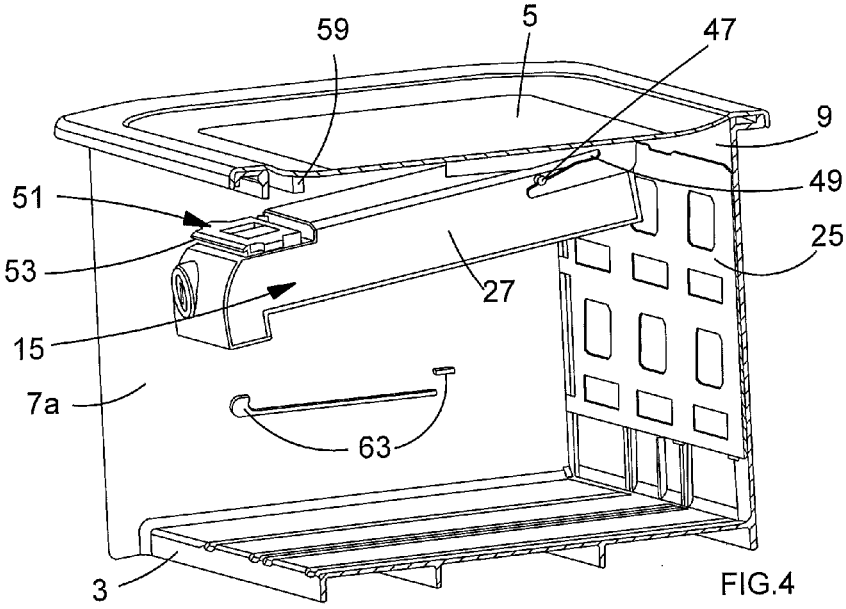
FIG. 4 shows another cross-sectional view of a storage assembly similar to that shown in FIGS. 3*a* and 3*b;*
Figure 5A:
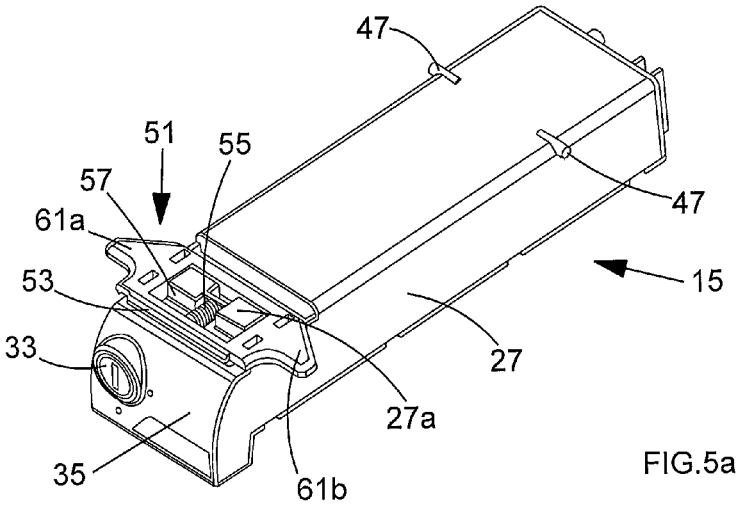
FIGS. 5*a* and 5*b* show a locking unit similar to that shown in FIG. 4.
Figure 5B:
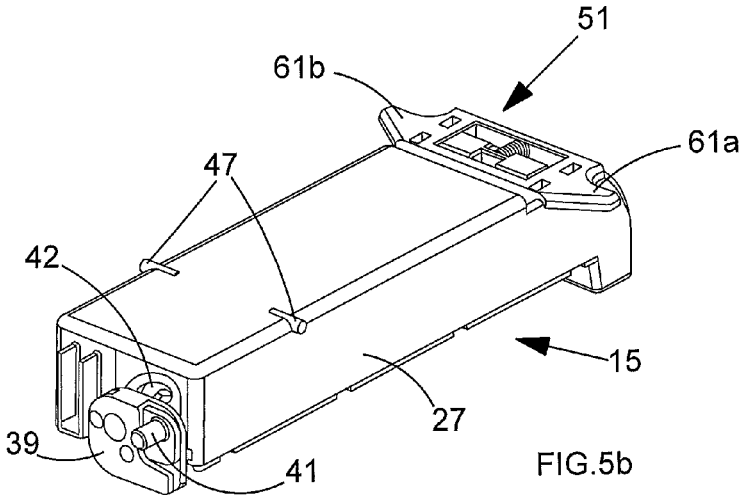
Figure 6A:
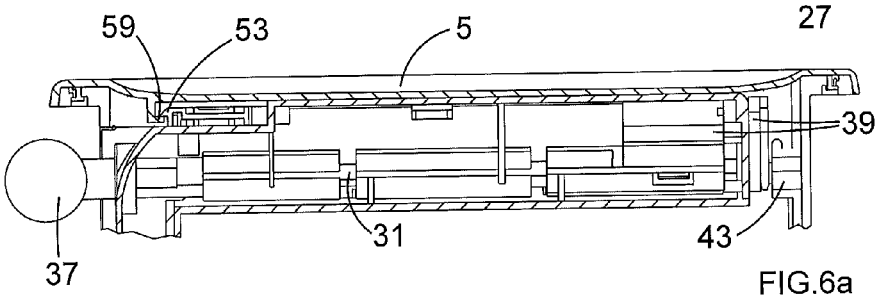
FIGS. 6*a* and 6*b* show partial cross-sectional views of another storage assembly.
Figure 6B:
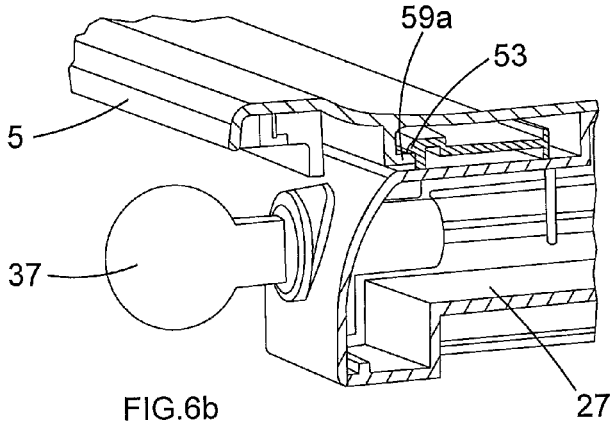

FIG. 4 shows another cross-sectional view of a storage assembly similar to that shown in FIGS. 3*a* and 3*b*. The locking member 25 in the form of a frame is preferably shown located on the back wall 9 inside the container 1. Additionally, the locking unit 15 is shown in a state of partial removal/attachment from/to the inside of the top wall 5 of the container. A very similar locking unit 15 is also shown in FIGS. 5*a* and 5*b*. The support 27 of the locking unit 15 is preferably in the form of an elongate housing through which extends the shifting part 29, from the lock 33 at the front 35 of the housing, to the lifting arrangement 39 including the eccentrically mounted pin 41, the lifting arrangement extending through the curved slot 42 in the rear wall of the support housing 27. An upper rear region of the support housing 27 preferably carries a pair of engagement members 47 on opposite sides thereof, in the form of projections, which may be arranged to be received in corresponding receiving members 49 (only one of which is shown), in the form of slots provided in wall portions depending from the top wall 5 inside the container.

FIGS. 4 and 5 also show the retaining part 51 of the locking unit 15, which is preferably carried by the support 27. The retaining part 51 may comprise a latch member 53 which is resiliently biased away from the support 27 by a resilient member 55 in the form of a helical spring. The helical spring 55 is preferably located between an upstanding part 27*a* of the support 27 and a portion of the latch member 53, in an opening 57 in the latch member.

As shown in FIGS. 3*a*, 3*b*, 6*a* and 6*b*, the latch member 53 of the locking unit 15 may be arranged to releasably engage with a protruding part 59 of the container 1, which protrudes from the top wall 5 into the interior of the container. The protruding part 59 may include a lip 59*a* (see FIG. 6*b*) with which a front part of the latch member 53 engages. The retaining part 51 also preferably includes a pair of tabs 61*a* and 61*b* projecting from opposite lateral sides of the locking unit 15, to enable a user to push the latch member 53 backwards against the resilience of the spring 55, to release the latch member from the protrusion 59, thereby allowing the locking unit 25 to be removed from the storage assembly, for example to aid cleaning of the interior of the container 1 and/or for replacement of the locking unit 25. It can be seen, for example from FIGS. 1 and 3, that the tabs 61*a* and 61*b* are not accessible while the drawers 13 are located in the container 1, and thus when the lock 33 is locked, neither the drawers nor the locking unit 15 can be removed from the container 1.

FIG. 4 also shows one set of a plurality of attachment profiles 63 for removably attaching the shelf-like dividers 17 on which the drawers 13 are arranged to slide. The dividers 17 may be located in place, and removed as desired, by rotating and withdrawing them from the interior of the container 1.

Figure 7:
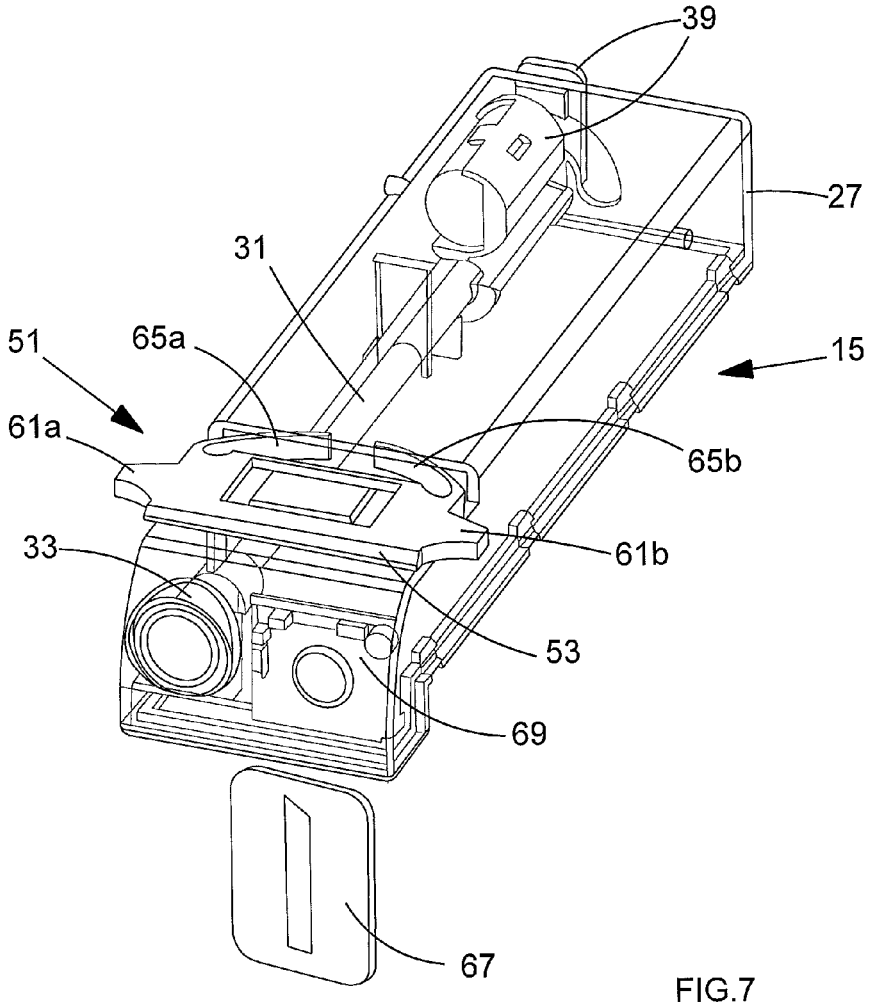
FIG. 7 shows a partially transparent view of a further locking unit of a storage assembly.

FIG. 7 shows a partially transparent view of a further locking unit 15 of a storage assembly. This locking unit 15 is substantially the same as those shown in the preceding figures, except for two main features. Firstly, in place of the helical spring 55 a pair of resiliently flexible arms 65*a* and 65*b* (e.g. formed from polymeric material) provide the resilient members to resiliently bias the latch member 53 away from the support housing 27. The flexible arms 65 abut against a part (not shown) of the support 27. Secondly, the lock 33 is preferably arranged to be unlocked by means of a radio frequency identification (RFID) transponder 67 which can be read by an RFID reader 69 located adjacent to the lock in the locking unit 15.

It will be understood that the above description and the drawings are of particular examples of the invention, but that other examples of the invention are included in the scope of the claims.

What is claimed is:

1. A storage assembly comprises:

a container;

a plurality of drawers arranged to be located in the container; and a gang lock arrangement comprising a locking member located in the container and a locking unit locatable in the container;

the locking unit comprising a support, and a shifting part and a retaining part carried by the support;

the shifting part being arranged to move the locking member with respect to the container such that the locking member releasably engages with, and thus releasably retains, the plurality of drawers in the container; and wherein the retaining part comprises a resiliently biased latch member arranged to releasably retain the locking unit in the container, wherein the latch member includes at least one tab for a user to move to release the latch member, and thus the locking unit, from the container.

2. The storage assembly according to claim 1, wherein the latch member is resiliently biased with respect to the support.

3. The storage assembly according to claim 1, further comprising at least one resilient member arranged to resiliently bias the latch member.

4. The storage assembly according to claim 3, wherein the resilient member is arranged to bias the latch member away from at least part of the support.

5. The storage assembly according to claim 3, wherein the resilient member is located between the latch member and at least part of the support.

6. The storage assembly according to claim 3, wherein the resilient member comprises one of a spring and a resiliently flexible arm.

7. The storage assembly according to claim 1, wherein the latch member is arranged to releasably engage with a part of the container located in the interior thereof.

8. The storage assembly according to claim 1, wherein the latch member is arranged to releasably engage with a protruding part of the container.

9. The storage assembly according to claim 1, wherein the support of the locking unit includes at least one engagement member spaced apart from the latch member, and the interior of the container includes at least one corresponding receiving member arranged to receive the at least one engagement member, to assist in the retention of the locking unit in the container.

10. The storage assembly according to claim 1, wherein the support of the locking unit comprises a housing thereof.

11. The storage assembly according to claim 10, wherein the shifting part extends through, and out of, the housing of the locking unit.

12. The storage assembly according to claim 10, wherein the latch member is at least partly located on the exterior of the housing.

13. The storage assembly according to claim 1, wherein the locking unit has at least one dimension of the group consisting of length, depth and width substantially the same as the drawers.

14. The storage assembly according to claim 1, wherein a front surface of the support of the locking unit is arranged to be substantially level with corresponding front surfaces of the drawers, when the locking unit is located in the container and the drawers are retained in the container by the locking member.

15. The storage assembly according to claim 1, wherein the locking unit further comprises a lock to lock the shifting part in a position in which the locking member is in engagement with, and thus retains, the plurality of drawers in the container.

16. The storage assembly according to claim 1, wherein the locking member is removable from the container.

17. A storage assembly comprises:

a container;

a plurality of drawers arranged to be located in the container; and a gang lock arrangement comprising a locking member located in the container and a locking unit locatable in the container;

the locking unit comprising a support, and a shifting part and a retaining part carried by the support;

the shifting part being arranged to move the locking member with respect to the container such that the locking member releasably engages with, and thus releasably retains, the plurality of drawers in the container; and wherein the retaining part comprises a resiliently biased latch member arranged to releasably retain the locking unit in the container, wherein a front surface of the support of the locking unit is arranged to be substantially level with corresponding front surfaces of the drawers, when the locking unit is located in the container and the drawers are retained in the container by the locking member.

18. A storage assembly comprises:

a container;

a plurality of drawers arranged to be located in the container; and a gang lock arrangement comprising a locking member located in the container and a locking unit locatable in the container;

the locking unit comprising a support, and a shifting part and a retaining part carried by the support;

the shifting part being arranged to move the locking member with respect to the container such that the locking member releasably engages with, and thus releasably retains, the plurality of drawers in the container; and wherein the retaining part comprises a resiliently biased latch member arranged to releasably retain the locking unit in the container, wherein the locking unit further comprises a lock to lock the shifting part in a position in which the locking member is in engagement with, and thus retains, the plurality of drawers in the container.

* * * * *